US007413702B2

(12) United States Patent
Lu et al.

(10) Patent No.: US 7,413,702 B2
(45) Date of Patent: Aug. 19, 2008

(54) ADVANCED SINTERING PROCESS AND TOOLS FOR USE IN METAL INJECTION MOLDING OF LARGE PARTS

(75) Inventors: Jyh-Woei J. Lu, Chandler, AZ (US); Richard L. Bye, Morristown, NJ (US); John N. Tervo, Scottsdale, AZ (US); Jerry C. LaSalle, Montclair, NJ (US)

(73) Assignee: Honeywell International Inc., Morristown, NJ (US)

( * ) Notice: Subject to any disclaimer, the term of this patent is extended or adjusted under 35 U.S.C. 154(b) by 499 days.

(21) Appl. No.: 11/170,866

(22) Filed: Jun. 30, 2005

(65) Prior Publication Data

US 2007/0003426 A1 Jan. 4, 2007

(51) Int. Cl.
*C21B 3/00* (2006.01)
*F27D 5/00* (2006.01)

(52) U.S. Cl. ..... 266/274; 432/258

(58) Field of Classification Search ..... 266/274; 432/258

See application file for complete search history.

(56) References Cited

U.S. PATENT DOCUMENTS

| | | | | |
|---|---|---|---|---|
| 4,039,703 | A | 8/1977 | Kamijo et al. | |
| 4,552,197 | A | 11/1985 | Mills | |
| 4,617,977 | A | 10/1986 | Mills | |
| 4,786,542 | A | 11/1988 | Yasuda et al. | |
| 5,068,071 | A | 11/1991 | O'Holleran | |
| 5,149,264 | A | 9/1992 | Horikawa et al. | |
| 5,340,510 | A | 8/1994 | Bowen | |
| 5,380,179 | A | 1/1995 | Nishimura et al. | |
| 5,710,969 | A * | 1/1998 | Newman | 419/5 |
| 5,911,102 | A | 6/1999 | Takahashi et al. | |
| 5,977,230 | A | 11/1999 | Yang et al. | |
| 6,244,870 | B1 | 6/2001 | Sakata et al. | |
| 6,299,664 | B1 | 10/2001 | Matsumoto et al. | |
| 6,838,046 | B2 | 1/2005 | Lu et al. | |
| 2002/0168282 | A1 | 11/2002 | Lu et al. | |

FOREIGN PATENT DOCUMENTS

| | | | |
|---|---|---|---|
| EP | 0633440 | A1 | 1/1995 |
| EP | 0701875 | A1 | 3/1996 |
| JP | 3039405 | A | 2/1991 |
| JP | 10273703 | A | 10/1998 |
| JP | 2001192274 | A | 7/2001 |
| WO | PCT/US2006/025228 | | 11/2006 |

* cited by examiner

*Primary Examiner*—Roy King
*Assistant Examiner*—Ngoclan T Mai
(74) *Attorney, Agent, or Firm*—Ingrassia, Fisher & Lorenz, P.C.

(57) ABSTRACT

Tools and methods are provided for use in a process for sintering a metal injection molded body where the body comprises a material and having a first end, a second end, and a flowpath extending therebetween, the flowpath having a diameter. The tool assembly comprises an insert and an endcap. The insert is configured to be disposed in the body flowpath and has an inner surface, an outer surface, a first end, a second end, a channel, a slot having a width, an inner diameter and an outer diameter. The endcap is configured to be inserted at least partially into the channel at the insert first end when the slot width is increased, and at least a portion of the endcap has an outer diameter that is substantially equal to or larger than the insert inner diameter.

8 Claims, 5 Drawing Sheets

ADVANCED SINTERING PROCESS AND TOOLS FOR USE IN METAL INJECTION MOLDING OF LARGE PARTS

TECHNICAL FIELD

The present invention relates to metal injection molding of parts weighing over 250 grams and, more particularly, to methods and tools for use in metal injection molding.

BACKGROUND

Metal injection molding is a simple, cost-effective method that has widely been used to mold parts weighing less than 250 grams. This process has been used to inexpensively manufacture a myriad of components used in many different industries, such as automotive, firearms, and medical industries. Generally, metal injection molding includes four basic steps, namely, mixing fine metal powders with a binder to formulate a feedstock, molding the feedstock in an injection molding machine to form a green part, debinding the binder from the green part to produce a brown part, and sintering the brown part to form the component.

During sintering, the brown part is subjected to temperatures of at least about 2200° F. and may be as high as about 2800° F. for some iron-based alloy parts. When the brown part is exposed to such temperatures, it may become soft and susceptible to deformation. For small parts, such as those weighing less than 250 grams, the gravitational forces exerted on the part are relatively small and thus, do not cause the part to become structurally distorted. Thus, metal injection molding is an ideal manner by which to inexpensively produce small parts. However, when large parts, e.g. parts larger than 250 grams, are subjected to sintering temperatures, portions of the part may sag under its own weight. This may be particularly true when the large part includes walls that form a cylindrical section, such as in a flowbody. In such a case, the walls may cave inward or one part of the wall may, due to gravity, pull downward more than another part of the wall. In other cases, the large part may, in addition to having a cylindrical section, include side pieces formed thereon which, during sintering, may draw the wall downward as well. As a result, metal injection molding conventionally has not been used to produce large parts.

Thus, there is a need for a methods and tools that may be used for metal injection molding of parts of all sizes, including parts larger than 250 grams. It is also desirable for the methods and tools to be relatively inexpensive to use and produce. Moreover, it is desirable for the tools to be reusable. The present invention addresses one or more of these needs.

BRIEF SUMMARY

The present invention provides tool assemblies and methods for used in a process for sintering a metal injection molded body.

In one embodiment, and by way of example only, a tool assembly is provided for use in a process for sintering a metal injection molded body where the body comprises a material and having a first end, a second end, and a flowpath extending therebetween, the flowpath having a diameter. The tool assembly comprises an insert and an endcap. The insert is configured to be disposed in the body flowpath and has an inner surface, an outer surface, a first end, a second end, a channel, and a slot. The channel extends between the first and second ends. The slot is formed between the inner and outer surfaces and extends from the first end at least partially toward the second end. Additionally, the slot has an adjustable width. The insert has an inner diameter and an outer diameter, the insert outer diameter being smaller than the body flowpath diameter. The insert inner and outer diameters each capable of being increased when the slot width is increased. The endcap is configured to be inserted at least partially into the channel at the insert first end when the slot width is increased, and at least a portion of the endcap has an outer diameter that is substantially equal to or larger than the insert inner diameter.

In another embodiment, and by way of example only, a tool is provided for use in a process for sintering a metal injection molded body where the body comprises a material and having an outer surface and a side housing, the outer surface having a predetermined configuration, and the side housing is coupled to the outer surface at a predetermined angle relative thereto. The tool includes a stand configured to be disposed under the side housing and to support the side housing during sintering to prevent deformation of the outer surface predetermined configuration. The stand comprises a material capable of maintaining its configuration at temperatures at least about 2200° F. and up to about 2800° F.

In yet another embodiment, and by way of example only, a kit assembly is provided for use in a process for sintering a metal-injection molded body where the body comprises a material and having a first end, a second end, and a flowpath extending therebetween, the flowpath having a diameter. The tool assembly comprises an insert and an endcap. The insert is configured to be disposed in the body flowpath and has an inner surface, an outer surface, a first end, a second end, a channel, and a slot. The channel extends between the first and second ends. The slot is formed between the inner and outer surfaces and extends from the first end at least partially toward the second end. Additionally, the slot has an adjustable width. The insert has an inner diameter and an outer diameter, the insert outer diameter being smaller than the body flowpath diameter. The insert inner and outer diameters each capable of being increased when the slot width is increased. The endcap is configured to be inserted at least partially into the channel at the insert first end when the slot width is increased, and at least a portion of the endcap has an outer diameter that is substantially equal to or larger than the insert inner diameter.

In still another embodiment, and by way of example only, a method is provided for sintering a metal injection molded body to form a flowbody, where the body comprises a material and having a first end, a second end, a flowpath extending therebetween, an outer surface, and a side housing, the flowpath having a diameter, and the side housing coupled to the body outer surface. The method comprises disposing an insert assembly at least partially in the body flow path, the insert assembly comprising an insert and an endcap, the insert comprising a material and configured to be disposed in the body flowpath, the insert having an inner surface, an outer surface, a first end, a second end, a channel, and a slot, the channel extending between the first and second ends, the slot formed between the inner and outer surfaces and extending from the first end at least partially toward the second end, the slot having an adjustable width, the insert having an inner diameter and an outer diameter, the insert outer diameter being smaller than the body flowpath diameter, the insert inner and outer diameters capable of being increased when the slot width is increased, and the endcap comprising a material and having a base configured to be inserted at least partially into the channel at the insert first end when the slot width is increased, at least a portion of the endcap having an outer diameter that is substantially equal to or larger than the insert inner diameter, sintering the body and insert assembly, removing the endcap from the insert, after sintering, decreasing the insert outer diameter, and removing the insert from the body.

Other independent features and advantages of the preferred tool will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention. Additionally, although the apparatus are depicted as primarily being used in conjunction with a brown body, it will be appreciated that the apparatus may be employed with green bodies or other flowbodies having at least one flowpath formed therein.

Figure 2:
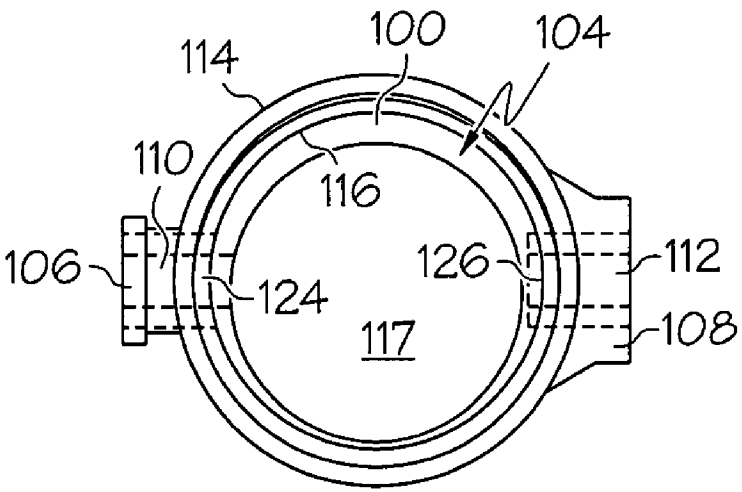
FIG. 2 is a top view of the exemplary brown body depicted in FIG. 1.
Figure 1:
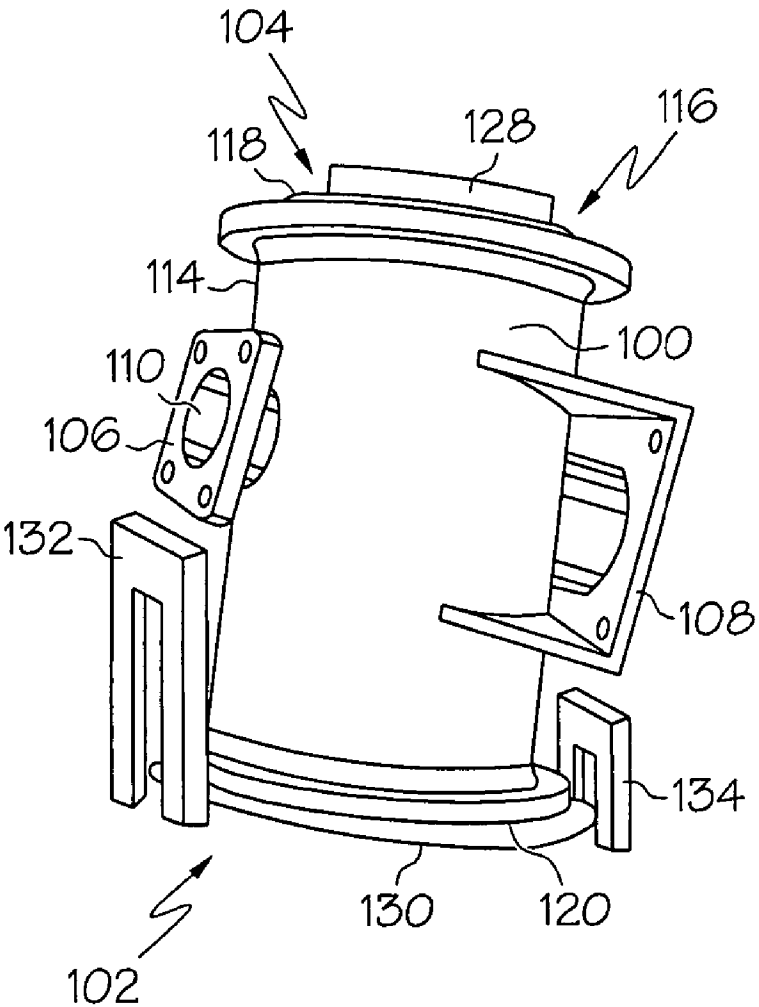
FIG. 1 is a perspective view of an exemplary brown body having an exemplary tool assembly that may be used in a sintering process.

FIGS. 1 and 2 illustrate a brown body 100 and an exemplary tool assembly 102 positioned therearound before a sintering process. It will be appreciated that the brown body 100 shrinks a predetermined amount after being exposed to the sintering process. Thus, as illustrated in FIG. 1, the brown body 100, in relation to the tool assembly 102, is a percentage larger in size than the tool assembly 102. In one example, the brown body 100 is between about 125% and 167% of its post-sintered size; accordingly, the tool assembly 102 has dimensions that are about between 60% to 80% in size of the brown body 100. The brown body 100 may have any weight, including a weight over 250 grams.

The brown body 100 depicted herein is shaped like a butterfly valve housing; however, it will be appreciated that the brown body 100 may be formed into any other similar type of component having a flow passage extending therethrough. The brown body 100 includes an outer surface 114, an inner surface 116, a first end 118, a second end 120, flowpath 104, and two side housings 106, 108.

The flowpath 104 extends between the brown body first and second ends 118, 120 and is defined by the brown body inner surface 116. In one exemplary embodiment, the flowpath 104 is configured to receive a valve diaphragm 117. Thus, the sections of the flowpath 104 proximate the first and second ends 118, 120 each have diameters that are greater than a diameter of at least portion of the flowpath 104 so that the flowpath 104 has an hourglass shape. Accordingly, the narrowest section of the flowpath 104 may be configured to couple to the diaphragm 117. In another exemplary embodiment, the flowpath 104 is cylindrical and has a uniform diameter along the length of its entirety.

The side housings 106, 108 are mounted to the brown body outer surface 114 across the flowpath 104 from one another and are configured to receive non-illustrated bearings therein. The side housings 106, 108 may be mounted on any section of the brown body outer surface 114 and may have any one of numerous suitable configurations. In the embodiment depicted in FIGS. 1 and 2, one side housing 106 is smaller than the other side housing 108 and is located substantially across the main flowpath 104 from the other side housing 108. The side housings 106, 108 each include side channels 110, 112 that communicate with the flowpath 104 via openings 124, 126 formed between the brown body outer and inner surfaces 114, 116. In one exemplary embodiment, the side channels 110, 112 and openings 124, 126 are non-perpendicular relative to the flowpath 104. However, the side channels 110, 112 may alternatively be disposed perpendicular to the flowpath 104 as well.

Figure 4:
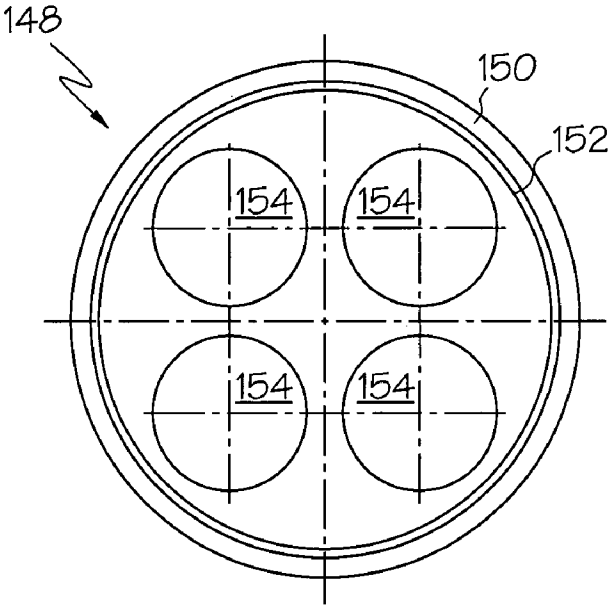
FIG. 4 is a top view of an end cap that may be used as part of the exemplary tool assembly depicted in FIG. 1.
Figure 5:
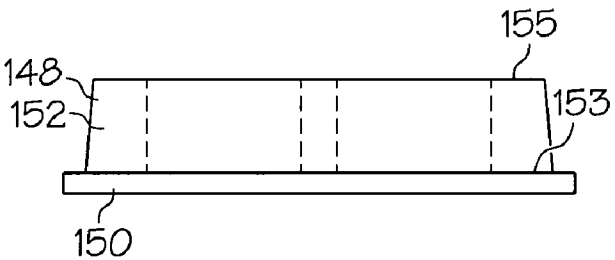
FIG. 5 is a side view of the end cap of FIG. 4.
Figure 3:
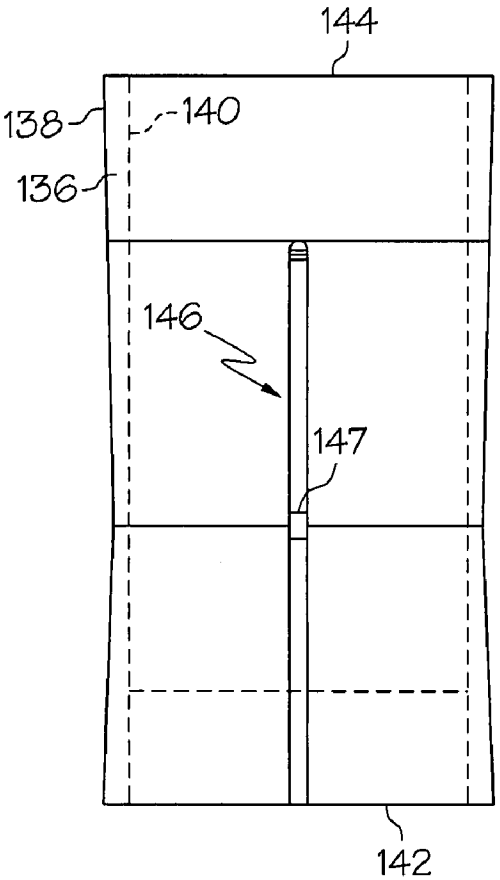
FIG. 3 is a cross section view of an insert that may be used as part of the exemplary tool assembly depicted in FIG. 1.

The tool assembly 102 includes an insert assembly 128, a setter plate 130, and a pair of stands 132, 134. With reference to FIGS. 3-5, the insert assembly 128 includes an insert 136 and an end cap 148. The insert 136 is configured to control the amount of shrinkage experienced by the brown body inner surface 116. In this regard, the insert 136 is made of material that does not shrink and is able to maintain its structural shape and integrity when exposed to sintering temperatures, such as temperatures of at least about 2200° F. and up to about 2800° F. In one exemplary embodiment, the insert material is a low carbon steel. However, any other suitable material may be employed as well, including, but not limited to precipitation hardening steels, such as 15-5PH and 17-7 PH, and austenitic stainless steels.

The insert 136 has an outer surface 138, inner surface 140, a first end 142, a second end 144, and a slot 146. The insert outer surface 138 has a shape that corresponds to the brown body flowpath 104 and, when assembled with the end cap 148, has dimensions that define preferable predetermined internal dimensions of the brown body flowpath 104. In one exemplary embodiment, such as where the brown body 100 has an hourglass-shaped flowpath 104, sections of the outer surface 138 proximate the insert first and second ends 142, 144 each have diameters that are larger than the diameter of at least a portion of the outer surface 138 between the insert first and second ends 142, 144.

The slot 146 is configured to allow the insert 136 to be collapsed to cause the insert 136 to have at least a smaller inner diameter. The slot 146 extends between the outer and inner surfaces 138, 140 and from the first end 142 at least partially toward the second end 144. It will be appreciated, however, that the slot 146 may alternatively extend from the second end 144 at least partially toward the first end 142, or in some circumstances, all the way from the first end 142 to the second end 144. The slot 146 has a width 147 that is adjustable. Thus, when the insert 136 is squeezed, the width 147 decreases. Alternatively, it the insert 136 is expanded, the width 147 increases. In either case, the width 147 of the slot 146 is preferably equal to or greater than a difference between the internal circumference of the end of the brown body 100 and the internal circumference of the center of the brown body 100. Additionally, although a single slot 146 is depicted, more than one slot 146 may be formed in the insert 136 as well. If more than one slot 146 is employed, they may be spaced equally apart from one another or spaced in any other suitable manner.

Turning now to FIGS. 4 and 5, views of the end cap 148 are provided. The end cap 148 is configured to maintain the insert outer and inner surfaces 138, 140 at predetermined shapes and diameters and to prevent the slot 146 from closing under the force of the brown body 100 as it shrinks during the sintering process. Thus, the end cap 148 is preferably constructed of the same or a similar material as the insert 136, or any other material capable of maintaining structural integrity when exposed to temperatures of at least about 2200° F. and up to about 2800° F. In one exemplary embodiment, the end cap 148 material is a low carbon steel. However, any other suitable material may be employed as well, including, but not limited to precipitation hardening steels, such as 15-5PH and 17-7 PH, and black iron pipe material.

In one exemplary embodiment, such as the embodiment illustrated in FIGS. 4 and 5, the end cap 148 includes a base 150 and an annular flange 152. The annular flange 152 has a first and a second annular edge 153, 155. The first annular edge 153 extends from the base 150. The second annular edge 155 mates with the insert 136 and thus, is inserted into the insert 136 at one end, preferably, the end from which the insert slot 146 originates. In one exemplary embodiment, at least a portion of the base 150 has an outer diameter that is substantially equal to or larger than the diameter of the insert inner surface 140. In another exemplary embodiment, the second annular edge 155 has a diameter that is substantially equal to or smaller than the diameter of the insert inner surface 140. Thus, the insert 136 may be squeezed to decrease its diameter via the slot 146 and then the end cap 148 may be inserted into the first end 142 of insert 136. To decrease the weight of the end cap 148 and to provide ease of insertion and removal of the end cap 148 from the insert 136, holes 154 may be formed therein. In FIG. 4, four holes 154 are shown, however, it will be appreciated that fewer or more holes may be employed as well.

Figure 6:
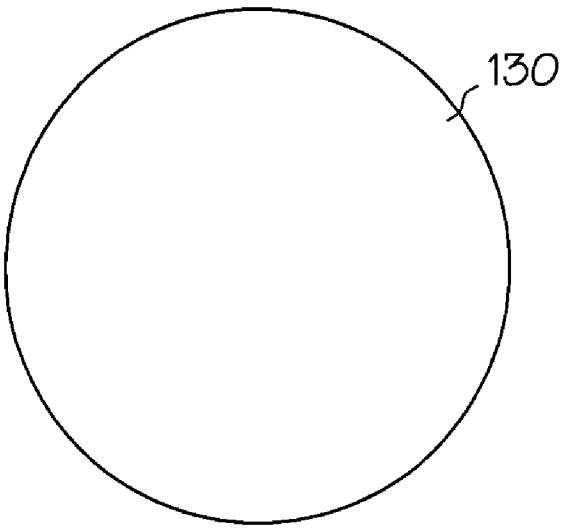
FIG. 6 a top view of a setter plate used in the exemplary tool assembly of FIG. 1.

FIG. 6 illustrates a top view of the setter plate 130. The setter plate 130 provides a surface on which the brown body 100 rests during sintering and is configured to shrink at substantially the same rate as the brown body 100. In this regard, the setter plate 130 may be constructed of any appropriate material, for example, the same material as the brown body 100. The plate 130 is preferably sized larger than the section of the brown body 100 that rests thereon. Additionally, although depicted as a round disk, the plate 130 may have any shape, including, but not limited to square, rectangular, or ovular.

Figure 7:
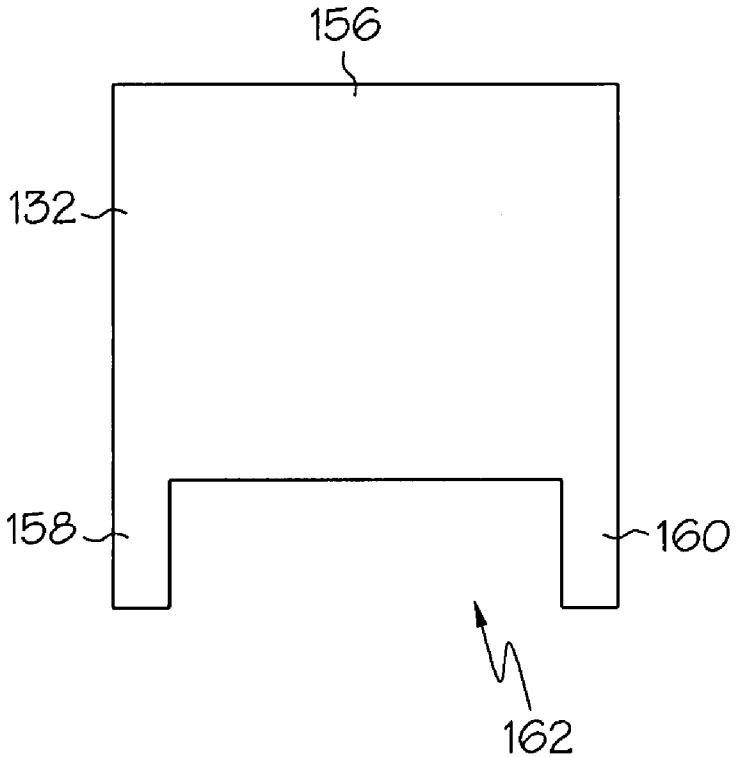
FIG. 7 is a side view of a stand used in the exemplary tool assembly of FIG. 1.

With reference to FIGS. 1 and 7, the stands 132, 134 are configured to support the side housings 106, 108 so that the weight of the side housings 106, 108 does not pull on the brown body 100 and deform the flowpath 104 during sintering. Thus, the stands 132, 134 are constructed of suitable material that maintains structural shape, size, and integrity during exposure to sintering temperatures, or any other temperatures of at least about 2200° F. and up to about 2800° F. In one exemplary embodiment, the stand material is a low carbon steel. However, any other suitable material may be employed as well, including, but not limited to precipitation hardening steels, such as 15-5PH and 17-7 PH. In such embodiments, the stands 132, 134 have a predetermined height that allows the brown body side housings, 106, 108 to rest thereon after sintering. Thus, although the side housing 106, 108 may sag during sintering, the dimensions of the brown body 100 shrink such that the shape of the side housing channels 110, 112 do not become deformed. In another example, the stands 132, 134 are made of material that has a substantially similar rate of shrinking as the brown body 100, for example, the brown body 100 material. In such case, the stands 132, 134 are sized and configured to continuously contact the side housings 106, 108 during the sintering process. Though either shrinking or non-shrinking material may be used, stands made of non-shrinking material may be used in more than one sintering process.

In the exemplary embodiment shown in FIG. 7, the stand 132 includes a seat 156 and two legs 158, 160 coupled to the seat 156. A space 162 is provided between the two legs 158, 160 that allows at least a portion of the brown body 100 to rest therebetween. Any other suitable configuration may be employed as well. For example, the stands 132, 134 may each be blocks.

Figure 8:
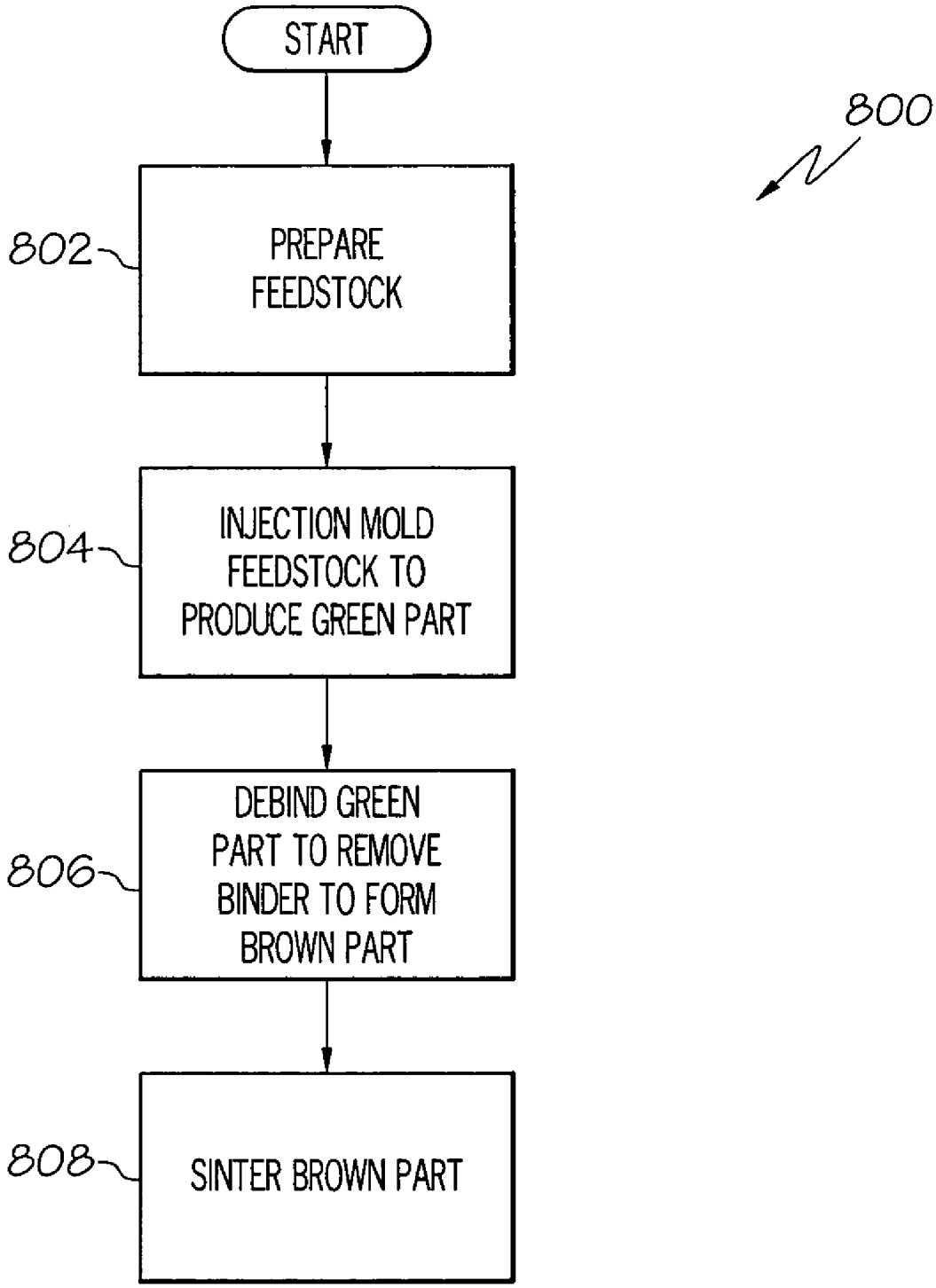
FIG. 8 is a flow chart of an exemplary method of metal injection molding of the exemplary brown body of FIG. 1.

The tool assembly 102 described above may be used in a method of metal injection molding a flowbody. With reference to FIG. 8, a flow chart of the general steps of the method of metal injection molding is illustrated. It should be understood that the parenthetical references in the following description correspond to the reference numerals associated with the flowchart blocks shown in FIG. 8. First, feedstock is made from a mixture of powdered metal and a binder (802). Then, the feedstock is injected into a mold to produce a green part (804). Next, the molded green part is debound to remove at least a portion of the binder to form a brown part (806). Lastly, the brown part is then sintered in a furnace (808).

As mentioned briefly above, feedstock is first made from a mixture of powered metal and binder (802). The powdered metal may be any one of numerous compositions of metals conventionally used in a metal injection molding process. Examples of suitable powdered metals include, but are not limited to Inconel 718 having a composition by weight percent of about 52.5 Ni, 18.5 Fe, 18.5 Cr, 5.1 Nv, 3 Mo, 0.9 Ti, 0.5 Al, and 0.4 C, or other materials such as 316 stainless steel and 17-4 PH steel, IN 600, and Hastelloy X. The binder used may be any type of composition used to bind the powder particles to one another, such as, for example, water gel binders, aqueous agar solutions, other water-based binders, or wax/polymer-based binders. The particular binder chosen depends on the powdered metal with which the binder will be mixed and the preference of the operator.

After the feedstock is prepared, it is metal injection molded (804) to form a green body having a predetermined, shape via a conventional metal injection molding apparatus. In one exemplary embodiment, the predetermined shape corresponds with the shape of the brown body 100 illustrated in FIG. 1. The green body may be molded into a part having a weight of greater than 250 grams and may have a wet, fluid consistency.

To at least partially solidify the part, the green body is debound to form the brown body 100 (806). In one exemplary embodiment, a water-based binder is used and the water is removed from the green body. Removal may be performed in any one of numerous manners. For example, the green body may be air-dried to evaporate the water, or quick-dried in a furnace at an elevated temperature. In other embodiments, such as for those methods using wax/polymer-based binders, the green body may be placed into a furnace and the wax may be removed by a melting process.

Figure 9:
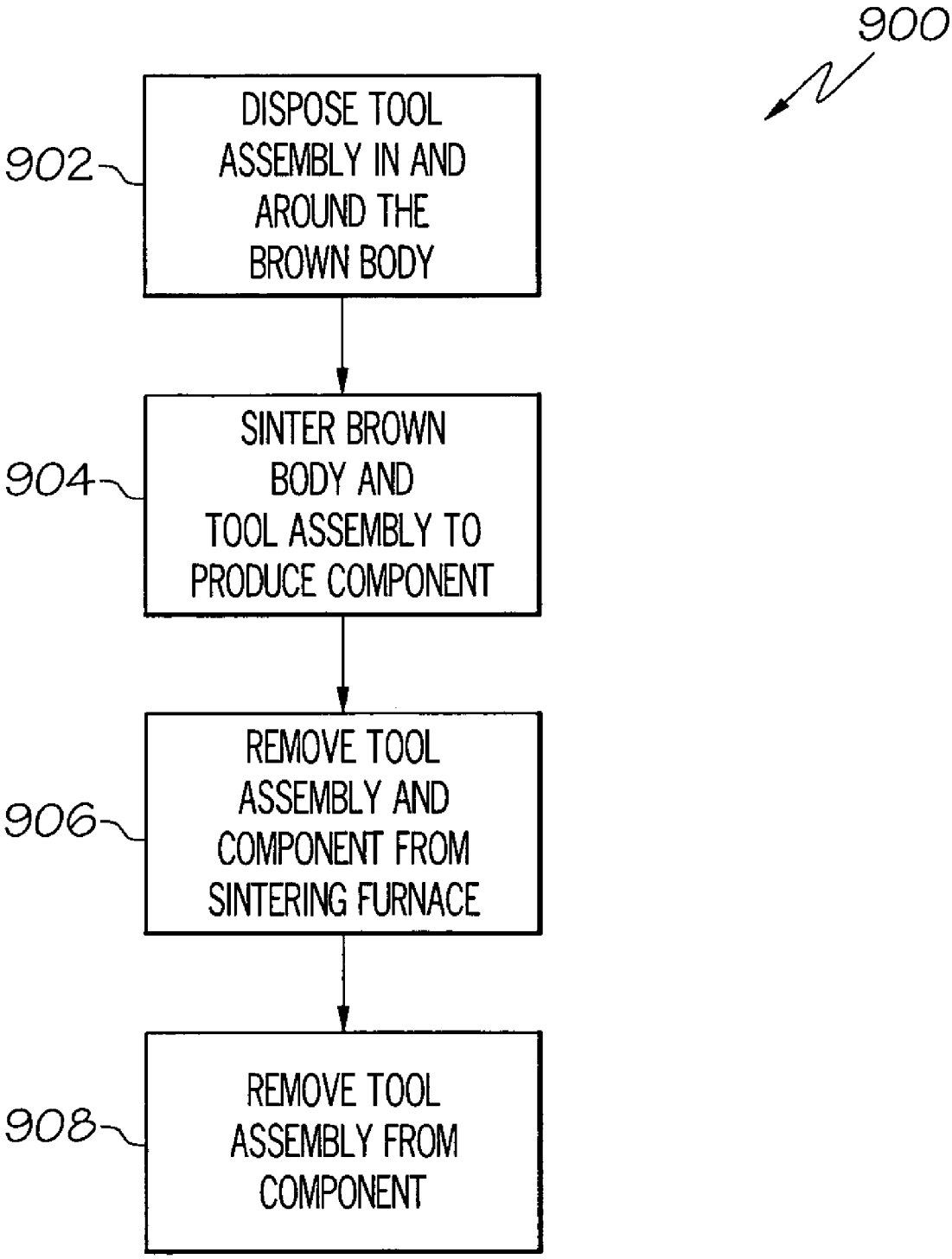
FIG. 9 is a flow chart of an exemplary method of sintering the exemplary brown body illustrated in FIG. 1.

After the brown body 100 is formed (806), it is placed into a furnace to undergo a sintering process (808). One exemplary sintering process (900) is illustrated in FIG. 9. First, the tool assembly 102 is disposed in and around the brown body 100 (902). Next, the brown body 100 and tool assembly 102 are sintered at a sintering temperature (904) to produce a component. Then the tool assembly 102 and component are removed from the sintering furnace (906) and the tool assembly 102 is removed from the component (908).

The step of placing the tool assembly 102 in and around the brown body 100 (902) may include several steps. In one exemplary embodiment, step (902) includes assembling the insert assembly 128. The endcap 148 may be mated with one end of the insert 136. Alternatively, the endcap annular flange 152 may be inserted into one end of the insert 136 to mate with the insert inner surface 140. In another exemplary embodiment, step (902) may further include placing the insert assembly 128 into at least a portion of the brown body flow path 104, after the insert assembly 128 is assembled. In such case, a coating comprising material that does not react with the insert material or the brown body material may be applied to the insert assembly 128. It will be appreciated that both the insert 136 and endcap 148 may be coated, or only the insert 136 may be coated. Suitable coating materials may include milk of magnesia, ceramic slurry, and alumina, however other appropriate materials may also be employed. In still another exemplary embodiment, step (902) includes placing the brown body 100 onto the setter plate 130. In still yet another exemplary embodiment, step (902) includes positioning the stands 132, 134 proximate the brown body side housings 106, 108. The stands 132, 134 may be coated with the same material with which the insert assembly 128 is coated. It will be appreciated that some or all of the above-mentioned steps may be combined to make up step (902) and that they may be performed in any appropriate order. Additionally, the aforementioned steps may be performed in a cooled sintering furnace, or, may alternatively be performed on a tray configured to be placed in a sintering furnace.

The brown body 100 and tool assembly 102 are then sintered to produce a component (904). Any conventional sintering process may be employed. In one example, the brown body 100 and tool assembly 102 are placed in a sintering furnace and exposed to temperatures of at least about 2200° F. and up to about 2800° F. As mentioned previously, the temperature exposure causes the brown body 100 to shrink to between about 60-80% of its original dimensions and the brown body flow path 104 to adopt the shape of the insert outer surface 138. As the brown body 100 shrinks, the setter plate 130 shrinks as well. In exemplary embodiments in which the stands 132, 134 are made of the same material from which the brown body 100 is made, the stands 132, 134 shrink during sintering as well. In other exemplary embodiments in which the stands 132, 134 comprise materials capable of maintaining size and configuration when exposed to sintering temperatures, the brown body 100 shrinks until its side housings 106, 108 contact the stands 132, 134.

After sintering, the tool assembly 102 and component are removed from the sintering furnace (906) and the tool assembly 102 is removed from the product (908). The step of removing the tool assembly 102 from the product may include several additional steps. In one example, while the insert assembly 128 is disposed within the component flow path, the endcap 148 is removed from the insert 136. In another example, after the endcap 148 is removed, the insert 136 is squeezed to decrease the insert's outer diameter. Specifically, two sides of the slot 146 may be pinched together or overlapped on top of one another. Once the insert 136 outer diameter is sufficiently decreased, the insert 136 may be removed from the component flow path. The component, stands 132, 134 and setter plate 130 are separated from one another. Subsequently, the component may be machined to a particular shape.

There has now been provided an method and apparatus for use during a metal injection molding process may be used for the molding of parts of all sizes, including parts larger than 250 grams. The methods and apparatus are relatively inexpensive to use and produce. Moreover, the tools are reusable.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A tool assembly for use in a process for sintering a metal injection molded body, the body comprising a material and having a first end, a second end, and a flowpath extending therebetween, the flowpath having a diameter, the tool assembly comprising:

an insert configured to be disposed in the body flowpath, the insert having an inner surface, an outer surface, a first end, a second end, a channel, and a slot, the channel extending between the first and second ends, the slot formed between the inner and outer surfaces and extending from the first end at least partially toward the second end, the slot having an adjustable width, the insert having an inner diameter and an outer diameter, the insert outer diameter being smaller than the body flowpath diameter, the insert inner and outer diameters each capable of being increased when the slot width is increased; and an endcap configured to be inserted at least partially into the channel at the insert first end when the slot width is increased, at least a portion of the endcap having an outer diameter that is substantially equal to or larger than the insert inner diameter.

2. The tool assembly of claim 1, wherein the insert comprises a material capable of maintaining a predetermined size and shape of the insert when exposed to temperatures of at least about 2200° F. and up to about 2800° F.

3. The tool assembly of claim 2, wherein the insert includes a coating disposed thereon, the coating comprising material is non-reactive with the insert material or the body material at least when exposed to temperatures up to about 2800° F.

4. The tool assembly of claim 1, wherein the body flow path has an hourglass shape and the insert outer surface has an hourglass shape.

5. The tool assembly of claim 1, wherein the end cap further comprises a base and an annular flange, the annular flange extending from the base and having an outer diameter that is substantially equal to or larger than the insert inner diameter.

6. The tool assembly of claim 5, wherein the annular flange has a first annular edge and a second annular edge, the first annular edge coupled to the base and having a diameter that is larger than a diameter of the second annular edge.

7. The tool assembly of claim 1, wherein the insert and endcap are between about 60% to about 80% smaller in dimensions than the body.

8. The tool assembly of claim 1, wherein the body has a weight greater than about 250 grams.

* * * * *